United States Patent [19]

Lohr

[11] Patent Number: 4,531,923

[45] Date of Patent: Jul. 30, 1985

[54] MAGNETIC SPINNER

[76] Inventor: Raymond J. Lohr, 5043 Sterrettania Rd., Erie, Pa. 16506

[21] Appl. No.: 430,768

[22] Filed: Sep. 30, 1982

[51] Int. Cl.[3] ..... A63H 33/26

[52] U.S. Cl. ..... 446/138; 273/1 M; 273/109; 446/137; 446/240; 446/445

[58] Field of Search ..... 46/62, 65, 202, 220, 46/236, 241, 228; 273/1 M, 109; 272/8 M; 446/240, 445, 132, 137, 138, 139

[56] References Cited

U.S. PATENT DOCUMENTS

| | | | |
|---|---|---|---|
| 1,005,853 | 10/1911 | Lewis | 46/202 |
| 2,198,075 | 4/1940 | Borek | 446/170 X |
| 3,093,377 | 6/1963 | Irwin | 273/112 X |
| 3,099,105 | 7/1963 | Martinez | 446/138 |
| 3,185,479 | 5/1965 | Ortega | 273/109 X |
| 3,201,127 | 12/1965 | Hupp | 273/109 |
| 3,451,161 | 6/1969 | Lemelson | 446/138 |
| 3,466,796 | 9/1969 | Greenblatt | 273/109 X |
| 3,611,632 | 10/1971 | Smith | 46/202 X |
| 3,826,497 | 7/1974 | Thomason | 273/126 A X |
| 4,031,660 | 6/1977 | Chen | 46/228 |

FOREIGN PATENT DOCUMENTS

| | | | |
|---|---|---|---|
| 429146 | 3/1925 | Fed. Rep. of Germany | 273/109 |
| 1031696 | 6/1958 | Fed. Rep. of Germany | 273/109 |
| 2223900 | 9/1973 | Fed. Rep. of Germany | 46/138 |
| 1386946 | 12/1964 | France | 273/109 |
| 1426823 | 12/1965 | France | 273/109 |

*Primary Examiner*—F. Barry Shay

*Attorney, Agent, or Firm*—Wayne Lovercheck; Charles L. Lovercheck; Dale R. Lovercheck

[57] ABSTRACT

An action toy in which a spinner is provided having two wheels joined with a magnetized axle which rotates along a single flat elongated wand. The wand has a return at each end so that the spinner will rotate along a first side of the wand and then along a second side as a player moves the wand from hand to hand. A pendant may be provided attached to an extension of the axle and having a magnet at its distal end for picking up various objects adding additional play value. The wand may be provided in a variety of shapes to present an interesting path for the spinner. A ramp may be provided which is readily attachable to the wand at a return to permit the passage of the spinner off of or onto the wand.

10 Claims, 12 Drawing Figures

MAGNETIC SPINNER

BACKGROUND OF THE INVENTION

This invention relates to action toys, and more particularly to a toy having an element which rolls back and forth along a hand held wand.

A well known toy which has been marketed for many years under the name WHEELO is that in which a wheel is provided with a magnetized axle having a ferrous extension projecting from each side of the wheel which rotates along two substantially parallel steel rails. The rails are u-shaped so that as they are waved up and down by a player, the wheel rotates along the outer edges of the rails and then along the inner edges. Each rail flares outwardly at its two ends so that the wheel axle can transfer from the outsides to the insides of the rails for continuous motion. A player holds the rails at one end and moves them up and down to impart to the wheel. It is the magnetized axle which causes the wheel to follow the rails. An improvement on the WHEELO which provides for illuminating the moving element by providing a bulb therein is U.S. Pat. No. 4,031,660. The problem with the substantially parallel rails has been that they are easily moved out of alignment and the wheel cannot follow the rails once its ferrous protrusions cannot reach both of the rails. The present invention overcomes this long existing problem and provides an enjoyable toy which will remain useful under the abuse of children's play.

An earlier example of a similar toy is shown in U.S. Pat. No. 1,005,853 which discloses a magnet of the horse shoe variety with a rotatable armature or keeper. The poles of the magnetic are so constructed as to cause the keeper to travel in a continuous circuit about the poles while under the magnetic force exerted by said poles. These examples do not teach the single metal rail or wand of the present invention.

SUMMARY OF THE INVENTION

The present invention comprises an improvement of the well known WHEELO type action toy wherein a single ferrous path is provided instead of the two paths which may be easily moved out of relative alignment with each other and rendered useless.

An action toy is provided in which a spinning element is provided having two wheels joined with a magnetized axle which rotates along a single flat elongated wand. The wand has a return at each end so that the spinner will rotate along the first side of the wand and move around the return and then along a second side as a player moves the wand hand to hand. Similarly at the second end the spinner will move along from the second side around the return and then along the first side of the wand.

A pendant may be provided attached to an extension of the axle and having a magnet at its distal end for picking up various objects and thereby adding additional play value. The wand may be provided in a variety of shapes to present an interesting path for the spinner. These shapes may include half circle, curved, zigzag, twist.

An easily detachable ramp may be provided which is readily attachable to the wand at a return to permit passage of the spinning element off of or onto the wand.

An object of the invention is to provide an improved toy.

Another object of the invention is to provide an action toy that is exciting to play with but that does not break easily.

Another object of the invention is to provide a toy that is easy to manufacture and economical to produce.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE PREFERRED EMBODIMENTS

Figure 1:
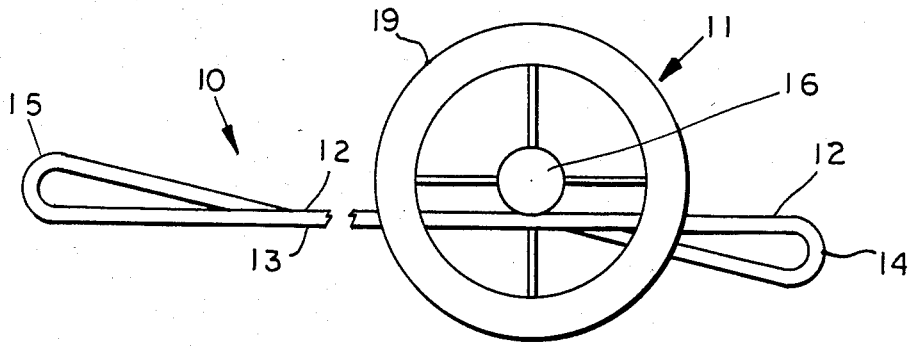
FIG. 1 is a front view of the magnetic spinner on a straight wand.
Figure 2:
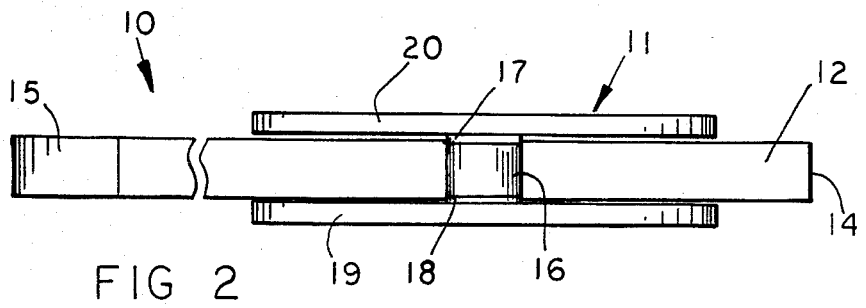
FIG. 2 is a top view of a magnetic spinner on a straight wand.

Now, with more particular reference to the drawings, a toy comprising a magnetic spinner 11 and a wand 10 is disclosed. The spinner, generally referred to as 11, has two wheels 19 and 20, as shown in FIGS. 1 and 2, and a magnetized axle 16. A ferrous washer which acts as a pole piece 18 is placed between the first wheel 19 and the magnetized axle 16, and a second ferrous washer which acts as a pole piece 17 is placed between the second wheel 29 and the axle 16. The pole pieces 17 and 18 have diameters slightly larger than the diameter of the axle 16 so that the spinner will contact the wand at the poles pieces. The poles pieces will focus the lines of force of the magnet in the axle which extend from the magnet through the pole pieces and through the wand. The magnetized axle rotates along an elongated flat wand generally referred to as 10 in the drawings and made of a ferrous material. The wand 10 has two sides 12 and 13 that act as a path for the spinner and may be provided with two returns 14 and 15 that allow the spinner to pass from the path on one side 12 of the wand to the path on the other side 13 of the wand. The player moves the wand from hand to hand as the spinner moves along the path on the sides 12 and 13 of the wand 10 to keep the spinner moving and to keep from impeding the movement of the spinner. The magnetized axle 16 and adjacent poles pieces 17 and 18 act as the means for keeping the spinner 11 on the ferrous wand 10 during the motion.

Figure 3:
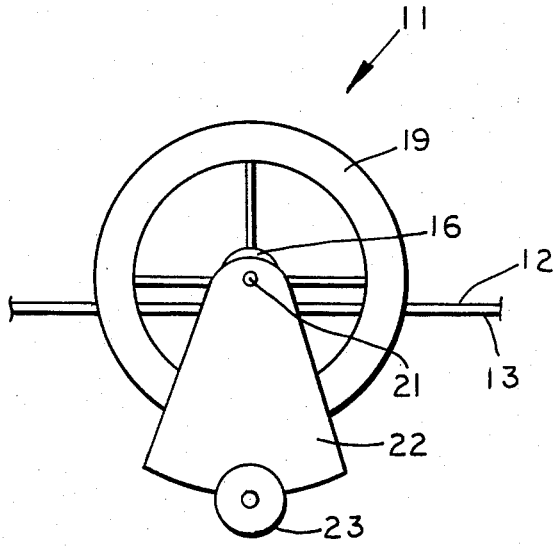
FIG. 3 is a front view of a magnetic spinner on a wand with a pendant attached to an extension of the axle.
Figure 4:
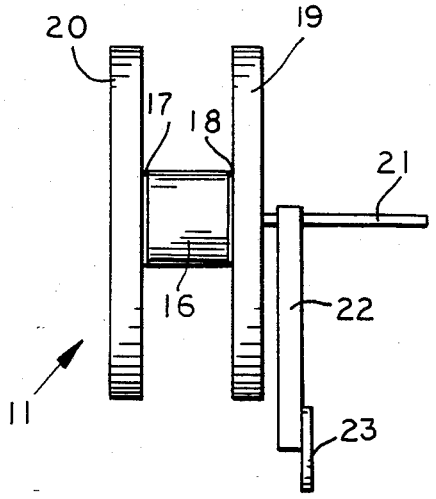
FIG. 4 is a side view of the magnetic spinner with a pendant attached to an extension of the axle.

In a second embodiment of the invention, an arm 21 extends from the axle 16 of the spinner as shown in FIGS. 3 and 4. A pendant 22 is attached to the arm 21. The pendant includes a magnet 23 which the person playing with the toy can use to pick up ferrous objects from a playing surface 25 for entertainment purposes.

Figure 5:
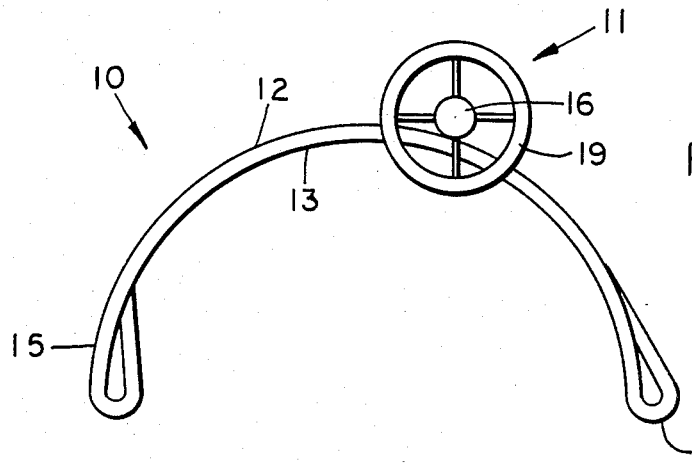
FIG. 5 is a front view of a magnetic spinner on a wand in the form of a half circle.
Figure 6:
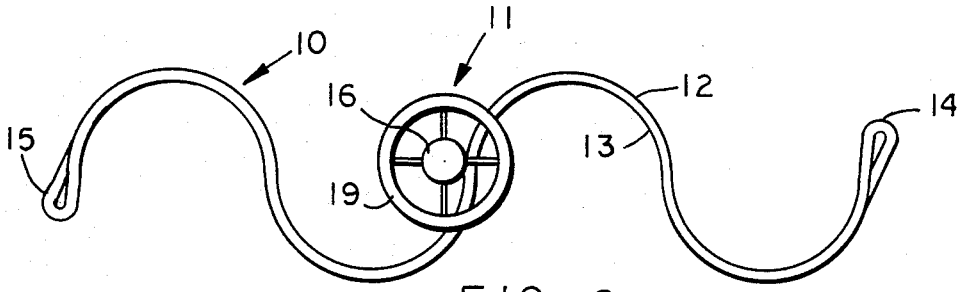
FIG. 6 is a front view of a magnetic spinner on a curved wand.

The wand 10 may be of any desired length and extend along its length in a generally straight path as shown in FIGS. 1 through 3. In alternative embodiments the wand may be curved to form a half circle as illustrated in FIG. 5 or a wave-like path as illustrated in FIG. 6. The path the spinner follows can also be circular as shown in FIG. 7 or twisted as shown in FIG. 8.

Figure 7:
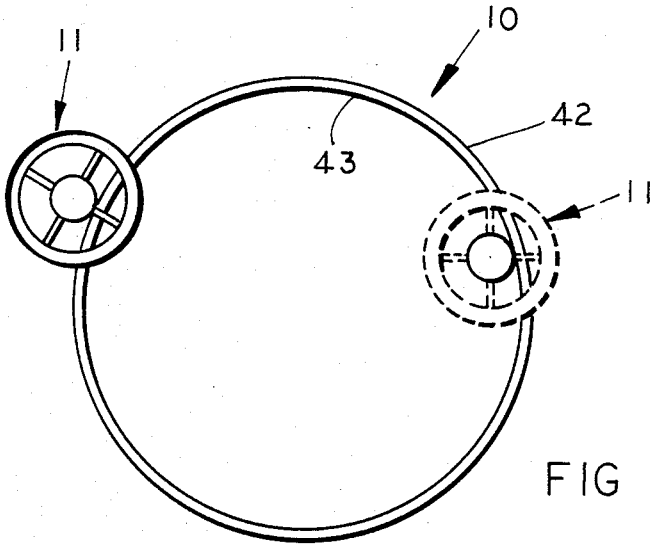
FIG. 7 is a front view of a magnetic spinner on a wand forming a circular path.
Figure 8:
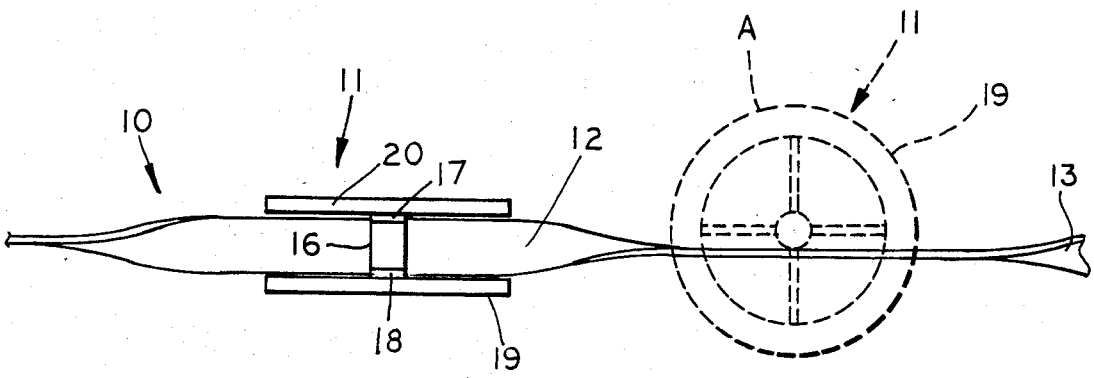
FIG. 8 is a front view of a magnetic spinner on a twisted wand.
Figure 9:
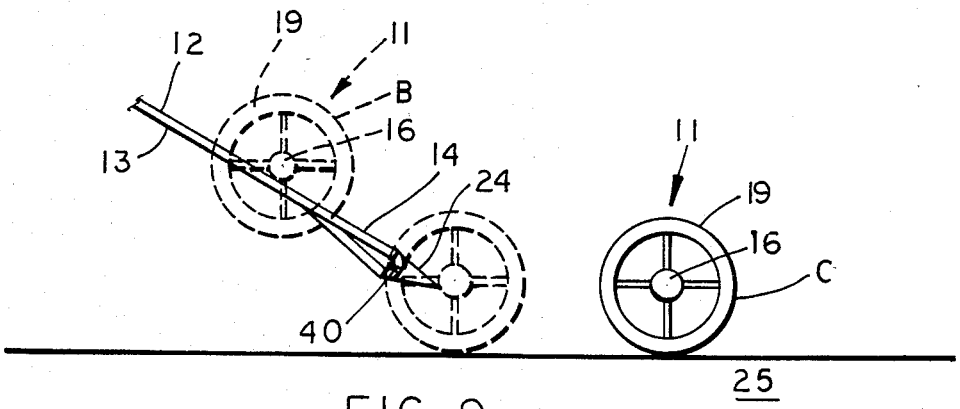
FIG. 9 is a front view of a ramp attachment for the wand of the magnetic spinner.

In FIG. 7 the entire wand is a closed loop which has an outer side 42 and an inner side 43. The spinner 11 can travel upon the outer side 42 or the inner side 43. The spinner on this wand may be switched from the outer side to the inner side only by leaving the outer surface and being manually placed on the inner surface.

Figure 10:
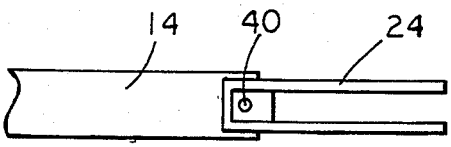
FIG. 10 is a top view of a ramp attachment for the wand of the magnetic spinner.
Figure 11:
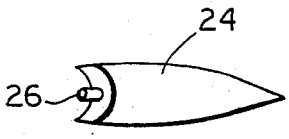
FIG. 11 is a prespective view of a ramp attachment for the wand of the magnetic spinner.
Figure 12:
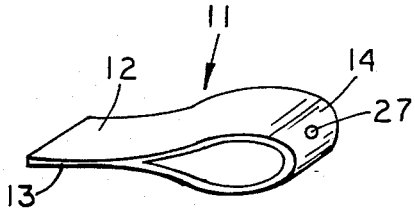
FIG. 12 is a perspective view of a return showing the attaching means for the ramp.

A ramp 24 may quickly be attached to a return by a player during play as shown in FIGS. 9 through 12. The ramp 24 can be attached to the return 14 to allow the player to direct the spinner off the wand and onto a playing surface 25. The spinner rolls from position B shown in phantom lines on FIG. 9 onto the nonferrous ramp 24 also indicate in phantom and then onto the playing surface as indicated by position C. The spinner may also be rolled onto the wand by positioning the ramp in the path of a spinner rolling on the playing surface. The ramp 24 has attaching means 40 which may consist of a peg 26 extending outwardly from the ramp which fits into a hole 27 in the return means 14 of the wand 10. The peg is adapted to hold the ramp in place during use. The ramp 24 may consist of two legs 28 and 29 as shown in FIG. 10.

The flat sided wand provides a sturdy toy which is not subject to damage by being bent out of alignment.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A toy comprising:

a ferrous wand adapted to be manually grasped and manipulated, a spinner adapted to rotate along the wand, the wand comprising:

a flat elongated ferrous member having a first planar side and a second planar side, a first edge and a second edge, the first side and the second side being adapted to provide a runway for the passage of the spinner, said wand having end means joining said first and second sides whereby said spinner is adapted to traverse a continuous cycle therearound and to move without stopping into another cycle, said wand being devoid of any manipulating handle other than the wand itself so that in order to rotate the spinner uninterruptedly through a full cycle, the user must release and then regain his grasp on the wand, the spinner comprising:

an axle, a first wheel and a second wheel one mounted adjacent each end of the axle, the axle being a cylindrical permanent magnet, said wheels being spaced apart a distance substantially equal to the width of said wand, the first and second wheels being adapted to rotate in respective planes parallel to each other, adjacent to said edges and generally perpendicular to said sides when the spinner is rotated along the wand.

2. The action toy as defined in claim 1 wherein the spinner has a first pole piece adjacent the first wheel and a second pole piece adjacent the second wheel, the first pole piece and the second pole piece being disposed between the wheels and the magnet and adapted to together engage the wand sides during rotation therealong, the pole pieces comprising a first cylindrical end and a second cylindrical end at the poles of said cylindrical magnet, the end means comprising a first return means thereon adapted to permit the spinner to pass from the first side of the wand to the second side of the wand, the end means further comprising a second return means thereon adapted to permit the spinner to pass from the second side of the wand to the first side of the wand.

3. The action toy as defined in claim 1 which further comprises:

an arm extending outwardly from the first wheel, a pendant rotatably attached to the arm and extending beyond the perimeter of the wheel, a magnet attached to the distal end of the pendant whereby ferrous objects may be picked up by the magnet.

4. The action toy as defined in claim 3 wherein the arm is an extension of the axle.

5. The action toy as defined in claim 2 further comprising:

means detachably attachable at a said return means of the wand including a non-magnetic ramp providing a path onto or off of the wand for the spinner whereby the spinner may descend the wand and cross the ramp onto a playing surface, and the spinner may be collected from the playing surface by crossing the ramp onto the wand.

6. The action toy as defined in claim 2 wherein the first return means of the wand comprises a loop of ferrous metal providing a continuous path from the first side of the wand to the second side of the wand, the second return means of the wand comprises a loop of ferrous metal providing a continuous path from the second side of the wand to the first side of the wand.

7. The action toy as defined in claim 1 wherein the wand is curved along its length forming a curved path for the spinner to follow.

8. The action toy as defined in claim 7 wherein the curve is a half circle.

9. The action toy as defined in claim 1 wherein the wand is twisted along its length forming a twisted path for the spinner to follow.

10. The action toy as defined in claim 1 wherein the wand is circular shaped along its length forming a circular path for the spinner to follow.

* * * * *